US006234498B1

(12) United States Patent
Saku et al.

(10) Patent No.: US 6,234,498 B1
(45) **Date of Patent: *May 22, 2001**

(54) RIM MEMBER STRUCTURE OF SERVICE CART

(75) Inventors: Fumiaki Saku; Yutaka Oda, both of Tokyo (JP)

(73) Assignee: Jamco Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/158,064

(22) Filed: Sep. 22, 1998

(51) Int. Cl.[7] ..... B62B 3/02
(52) U.S. Cl. ..... 280/47.34; 280/770; 280/651
(58) Field of Search ..... 280/47.34, 47.35, 280/79.2, 79.3, 770, 651; 108/27, 161; 428/68; 403/52, 56, 76, 80, 381, 375; 296/191, 144

(56) References Cited

U.S. PATENT DOCUMENTS 3,510,055 * 5/1970 Safford ..... 232/43.2
3,710,895 * 1/1973 Freedman ..... 188/5
4,019,022 * 4/1977 Seider et al. ..... 219/386
4,576,425 * 3/1986 Pinnow et al. ..... 312/324
4,936,377 * 6/1990 DeVogel et al. ..... 165/47
5,436,048 * 7/1995 Meier et al. ..... 428/68
5,490,455 * 2/1996 Conti et al. ..... 100/50
5,605,344 * 2/1997 Insalaco et al. ..... 280/47.34
5,830,552 * 11/1998 Meier et al. ..... 428/68
5,947,037 * 9/1999 Hornberger et al. ..... 108/115

* cited by examiner

*Primary Examiner*—Brian L. Johnson
*Assistant Examiner*—Bridget Avery
(74) *Attorney, Agent, or Firm*—Armstrong, Westerman, Hattori, McLeland & Naughton, LLP

(57) ABSTRACT

A service cart comprises a box-shaped body formed of panels, and stores trays mounting tableware in the interior thereof. The side wall comprises a honeycomb panel 12 and a surface material 70, and on the rim portions thereof are mounted rim members 72. The rim member 72 is formed by joining together a first rim member element 73 and a second rim member element 74 being contacted to the outer side of the panel. When damaged, only the damaged second element 74 may be replaced.

1 Claim, 1 Drawing Sheet

RIM MEMBER STRUCTURE OF SERVICE CART

BACKGROUND OF THE INVENTION

The present invention relates to a rim member equipped in a service cart for serving in-flight meals on airplanes.

The in-flight meal server called a service cart for serving meals and beverages in a cabin of an airplane is equipped with a box-shaped body for storing trays, a caster mounted on the bottom portion of the body, and a space for positioning bottles and the like on the top portion of the body.

On the front and back sides of the body are equipped hinged doors, and on the front and back sides of the upper portion of the body are mounted handles for pushing the server.

SUMMARY OF THE INVENTION

The side wall surfaces of the box-shaped body are covered with a surface material of a decorative sheet and the like. Such surface material of the service cart may attract the attention of passengers, since it passes the eye level of the seated passengers.

Therefore, by displaying an advertisement or a trademark of a company, the company may effectively appeal to the passengers the service of the company.

However, the surface material of the service cart may easily be damaged, since the cart is used not only in the cabin, but also on land for loading food and the like.

Since such damage to the surface attracts the attention of passengers, it is necessary to replace the surface material at once.

In the conventional service carts for serving in-flight meals, there were no means to prevent the damage on the surface of the service carts which may cause the passengers to feel unpleasant, but it was difficult to repair such damage to the surface.

Therefore, the present invention aims at providing a rim member structure enabling easy replacement of the rim member equipped in a service cart for serving in-flight meals.

The rim member structure on the service cart of the present device comprises a service cart equipped with a box-shaped body for storing trays mounting tableware, hinged doors mounted on the front and back sides of said body, and a caster mounted on the lower portion of said body, wherein the side walls of said body comprises a honeycomb panel, a surface material covering the surface of said honeycomb panel, and rim members mounted on both side rim portions of said honeycomb panel and said surface material, said rim member composed of two members interfitting to one another.

PREFERRED EMBODIMENT OF THE INVENTION

Figure 1:
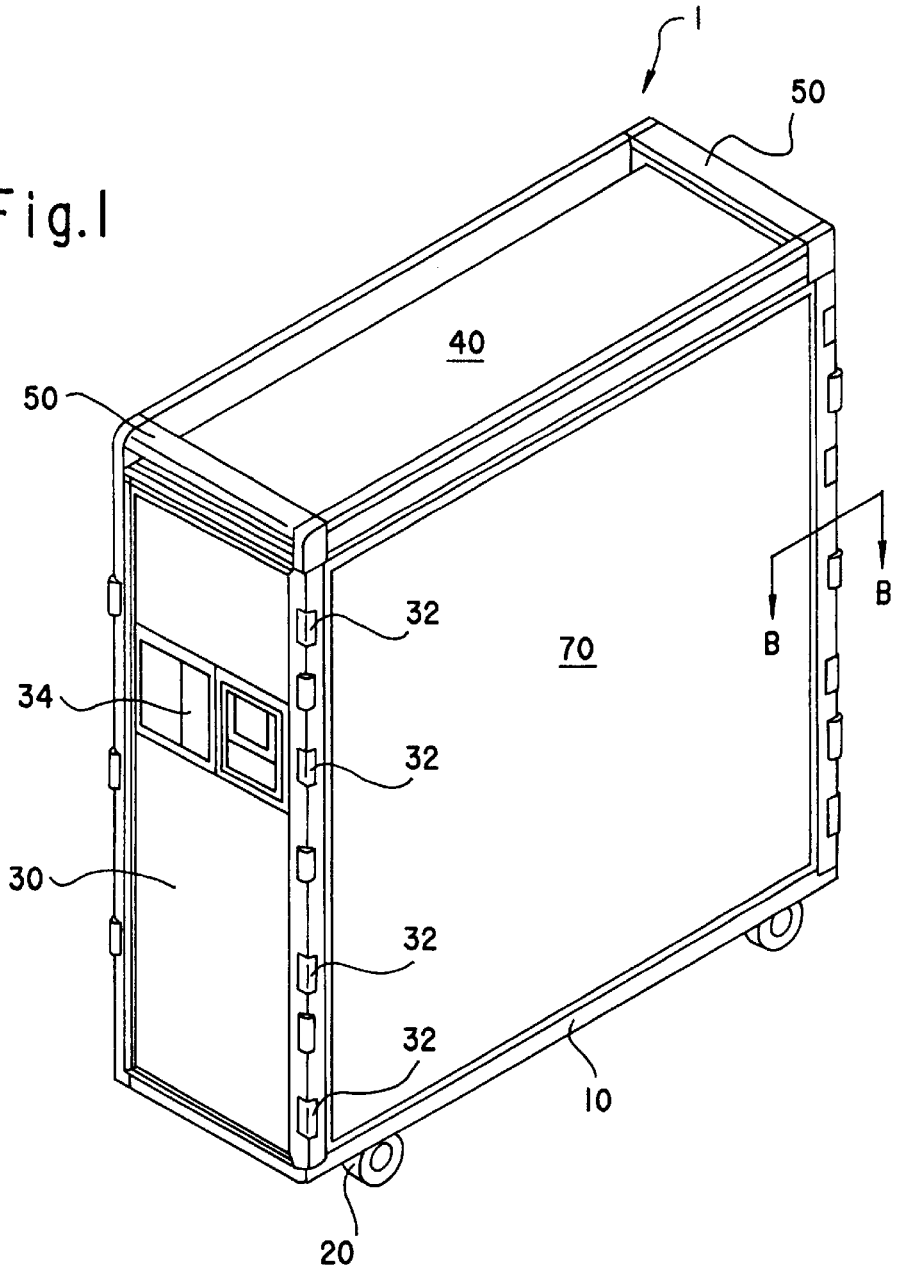
FIG. 1 is a schematic view of the service cart for in-flight meals applying the present device.
Figure 2:
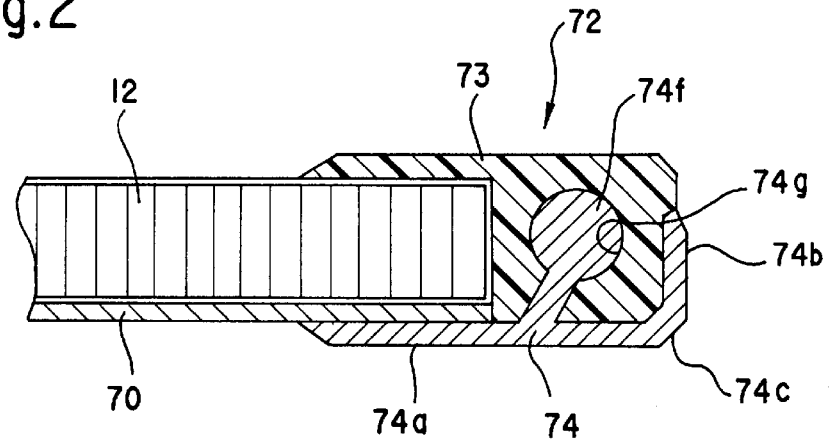
FIG. 2 is a cross-sectional view taken at line B—B of FIG. 1.

FIG. 1 is a schematic view of the service cart for serving in-flight meals applying the present device, and FIG. 2 is a cross-sectional view taken at line B—B of FIG. 1.

A service cart shown as a whole by the reference number 1 comprises a body 10 formed of a box-shaped panel material, and a caster 20 mounted on the lower portion of the body 10. On the front and back sides of the body 10 are mounted doors 30, which are supported by hinges 32 enabling the opening and closing movement of the door.

On the front surface of the door 30 is mounted a knob 34, and the lock of the door could be released by the operation of the knob 34.

The space 40 on the upper portion of the body 10 is used as a space for placing the bottles of beverages, ice, glasses and the like. Handles 50 are placed on the front and back sides of the upper portion of the body 10 so as to enable operation of the service cart.

The surface of the side walls of the body 10 is covered with a surface material 70. On the surface material are displayed an appropriate design and the like.

As shown in FIG. 2, the side wall of the body 10 comprises a honeycomb panel 12 and a surface material 70 covering the surface of the honeycomb panel 12, and on the rim portion thereof is mounted a rim member 72.

The rim member 72 is composed of a first rim member element 73 and a second rim member element 74.

The rim member 72 is structured so that the second rim member element 74 is removably interfitted to the separately formed first rim member element 73.

The first rim member element 73 and the second rim member element 74 are each manufactured by extruding aluminum alloy.

The surfaces 74*a*, 74*b* and 74*c* of the second rim member element 74 are positioned at the corner of the box-shaped service cart, and therefore it may easily be damaged by collision with other equipment. The second rim member 74, as illustrated in FIG. 2, has a depending cylindrical projection 74*f* extending inwardly therefrom which is enclosed within a bore 74*g* in the first rim member 72.

Therefore, according to the present invention, a rim member having a new outer peripheral surface could be prepared merely by exchanging the second rim member element 74. Simultaneously, the side wall surface material 70 could be exchanged easily. Accordingly, the appearance of the service cart could constantly be maintained to the initial status.

As explained above, the present device provides a service cart to be used in a cabin of an airplane and the like wherein the rim member mounted to the rim portion of the side wall of the cart which could easily be damaged and could easily attract the attention of passengers is composed of two members, and only the member on the outer side which is damaged could be replaced, thereby effectively reducing the cost of the member.

According to the device, the service cart could always be maintained to an aesthetically high quality at all times, and the improvement of services could be achieved.

What is claimed is:

1. A rim member structure of a service cart, said service cart comprising a box-shaped body for storing trays mounting tableware, hinged doors mounted on the front and back sides of said body, and a caster mounted on a lower portion of said body, wherein;

a side wall surface of said body comprises a panel material, a surface material covers the surface of said panel material, and rim members, manufactured by extruding aluminum alloy, having a first rim member element having a bore therein, and a second rim member element removably interfitted to said first rim member element and mounted on side rim portions of said panel material and said surface material, the second rim member element having a depending cylindrical projection extending inwardly therefrom which is enclosed within the bore of the first rim member element.

* * * * *

UNITED STATES PATENT AND TRADEMARK OFFICE

CERTIFICATE OF CORRECTION

PATENT NO. : 6,234,498 B1
DATED : May 22, 2001
INVENTOR(S) : Saku et al.

It is certified that error appears in the above-identified patent and that said Letters Patent is hereby corrected as shown below:

Title page,
Insert -- [30] Foreign Application Priority Data
December 5, 1997 (JP) ..... H9-10768 --

Signed and Sealed this

Nineteenth Day of November, 2002

*Attest:*

*Attesting Officer*

JAMES E. ROGAN
*Director of the United States Patent and Trademark Office*